US009004194B2

(12) United States Patent
Eddison et al.

(10) Patent No.: US 9,004,194 B2
(45) Date of Patent: Apr. 14, 2015

(54) DOWNHOLE TRACTOR

(75) Inventors: Alan Martyn Eddison, York (GB); David Anderson Coull, Montrose (GB); Derek James Stuart, Aberdeen (GB)

(73) Assignee: National Oilwell Varco, L.P., Houston, TX (US)

( * ) Notice: Subject to any disclaimer, the term of this patent is extended or adjusted under 35 U.S.C. 154(b) by 366 days.

(21) Appl. No.: 13/508,982

(22) PCT Filed: Nov. 10, 2010

(86) PCT No.: PCT/GB2010/002066

§ 371 (c)(1),
(2), (4) Date: Jul. 25, 2012

(87) PCT Pub. No.: WO2011/058307

PCT Pub. Date: May 19, 2011

(65) Prior Publication Data

US 2012/0279724 A1 Nov. 8, 2012

(30) Foreign Application Priority Data

Nov. 10, 2009 (GB) ..... 0919649.4

(51) Int. Cl.
*E21B 7/24* (2006.01)
*E21B 4/18* (2006.01)

(52) U.S. Cl.
CPC .... *E21B 4/18* (2013.01); *E21B 7/24* (2013.01)

(58) Field of Classification Search
USPC ..... 175/55, 56, 107, 232, 234
See application file for complete search history.

(56) References Cited

U.S. PATENT DOCUMENTS

| | | | | |
|---|---|---|---|---|
| 4,069,876 | A | 1/1978 | Pototsky | |
| 4,819,745 | A | 4/1989 | Walter | |
| 4,830,122 | A | 5/1989 | Walter | |
| 4,979,577 | A | 12/1990 | Walter | |
| 5,190,114 | A | 3/1993 | Walter | |
| 6,279,670 | B1 | 8/2001 | Eddison | |
| 7,281,575 | B2 * | 10/2007 | McElroy et al. | 166/178 |
| 7,405,998 | B2 | 7/2008 | Webb | |
| 8,069,926 | B2 | 12/2011 | Eddison | |
| 2005/0230101 | A1 | 10/2005 | Zheng | |
| 2007/0221412 | A1 | 9/2007 | Hall | |

OTHER PUBLICATIONS

Response to Office Action from European Application No. 10781978.1 dated Dec. 31, 2012, 12 pages.
PCT/GB2010/02066 International Search Report and Written Opinion dated Aug. 4, 2011.
GB0919649.4 Search Report dated Jan. 12, 2010.
Examination Report for European Patent Application No. 10781978.1 dated Feb. 19, 2013, 1 page.
International Report on Patentability for PCT Patent Application No. PCT/GB2010/002066 dated May 15, 2012, 6 pages.

* cited by examiner

*Primary Examiner* — William P Neuder
(74) *Attorney, Agent, or Firm* — JL Salazar Law Firm

(57) ABSTRACT

A method of translating a member through a bore involving moving fluid through a tubular member such as a drill string, and generating impulses on the member by varying the passage of fluid through the member using a valve which opens at a first rate and closes at a different second rate to urge the member to advance in a selected direction. The valve may close quickly and open slowly, or may close slowly and open quickly.

33 Claims, 15 Drawing Sheets

| absolute | graph (ref) | area in^2 | |
|---|---|---|---|
| 90 | 0 | 0.033 | lowest |
| 126 | 36 | 0.061 | |
| 162 | 72 | 0.113 | |
| 198 | 108 | 0.247 | |
| 234 | 144 | 0.436 | |
| 270 | 180 | 0.482 | |
| 306 | 216 | 0.572 | |
| 342 | 252 | 0.732 | |
| 358 | 268 | 0.757 | peak |
| 18 | 288 | 0.613 | |
| 54 | 324 | 0.241 | |
| 90 | 360 | 0.033 | |

75 deg shim (offset) on Oscillating plate
Model: NP1

DOWNHOLE TRACTOR

BACKGROUND OF THE INVENTION

1. Field of the Invention

This invention relates to tools used downhole, and particularly tools useful in very deep and/or very tortuous wells.

2. Description of the Related Art

Tractor devices are used when drilling for minerals in the earth when it becomes difficult or uneconomical to use traditional, gravity-assisted bottom hole assemblies. In high inclination or tortuous wells it can be difficult to push a drillstring, casing string or workstring along the wellbore due to excessive friction. This can be especially problematic with coiled tubing where the force that can be applied is limited by helical or sinusoidal lockup where the tubing string locks in the wellbore and any additional force applied from surface is not transferred to the bottom of the string. Various downhole tractor devices may be used to assist in propelling tubulars along a wellbore and can be especially useful for coiled tubing applications.

Downhole tractors typically rely on contact with casing or the wellbore to pull the tubing string along the borehole. Although this technique works acceptably in cased hole sections, it is less successful in an open or unlined hole because of inconsistent hole diameter and inadequate formation strength. Typical downhole tractor devices have mechanisms which engage the borehole wall with gripper-type devices, and then push downward on the drill string to force the drill bit into the formation being drilled. Because it is difficult to provide bearing assemblies in these tractor mechanisms that transfer the thrust to a rotating drill string, most tractor devices rely upon a drilling motor mounted in the drill string below the tractor to rotate the drill bit. To make the drill bit advance, the tractor mechanism pushes upon the drill pipe until the device reaches the end of its stroke.

When the end of the stroke is reached, the tractor device typically pulls the drill bit upward as far as its stroke allows and then releases from the borehole wall and is lowered downward or is 'walked' downward by pushing upon a second gripper assembly mounted above. As a result the device moves downward in the hole in a series of start/stopped increments. By way of example, two mechanisms of this type are described in U.S. Pat. Nos. 2,946,578 and 7,121,364.

Others tractor device use wheels or tracks to contact the bore wall and provide a continuous driving force.

BRIEF SUMMARY OF THE INVENTION

According to one aspect of the present invention there is provided a method of translating a member through a bore, the method including:

moving a body of fluid through a tubular member located in a bore; and generating impulses on the member from the body of fluid to urge the member to advance in a selected direction.

The impulses may be generated by interrupting or varying the passage of the fluid through the member. This may be achieved by the movement of a flow barrier mounted in the member, by varying the form or extent of a flow restriction, or by carrying solid materials in the fluid which temporarily interrupt or slow the passage of fluid through a restriction. A valve may be utilized to interrupt the flow of fluid. In other embodiments the impulses may be generated by pumping a fluid of varying form or make-up, for example by providing a multiphase fluid or a fluid comprising elements of different density or viscosity, or by generating pressure or flow waves or surges in the fluid.

According to another aspect of the invention there is provided a downhole tractor comprising:

a fluid-transmitting member; and a valve for varying fluid flow in the member, the valve being operable to open and close at rates selected to generate impulses from fluid flowing through the member and tending to urge the member in a selected direction.

The fluid transmitting member may include coil tubing, a drill string, a work string, completion or production tubing, casing or liner, or indeed any form or combination of tubing forms. The fluid transmitting member may include or be coupled or otherwise associated with a bottom hole assembly (BHA), tool or device mounted on a support member.

The valve may be integrated with the member and adapted to be run-in and retrieved together with the member. For example, the valve may be integrated with a BHA of a drill or work string. Alternatively, the valve may be retrievable. For example, the valve may be provided in a casing, liner or a completion, to facilitate running the tubular structure to target depth. The valve may then be retrieved, but in other embodiments may be adapted to be sacrificial, and may be configured to be drilled out.

The valve may be mounted in a substantially rigid section of the member. For example, if the fluid transmitting member includes coil tubing and a rigid tool body, the valve may be provided in the tool body.

The valve may take any appropriate form. When closed the valve may permit a degree of flow, or may substantially prevent flow.

The valve may be motor driven. The motor may take any appropriate form. The motor may be fluid actuated, and may include a positive displacement motor, such as a Moineau principle motor. Alternatively, or in addition, the motor may include a turbine or the like.

In other embodiments the valve motor may be an electric motor. The motor may utilize energy or power transmitted from surface, or a local power source.

In other embodiments the valve may include a valve member responsive to one or both of fluid flow, fluid pressure, or spring force. For example, the valve member may oscillate between open and closed positions, and may be bi-stable.

The valve may be configured to open and close at different rates. The valve may be configured to open at a first rate and close at a second rate. The first rate may be faster than the second rate, or the first rate may be slower than the second rate. Closing the valve quickly creates a sudden rise in pressure above the valve, and may also create a sudden decrease in pressure directly below the valve, both of which tend to urge the member in the direction of fluid flow. Opening the valve suddenly creates a surge of fluid below the valve. A flow restriction in the member downstream of the valve may then experience an impulse.

The valve may include a rotating element. The element may be configured to be rotated at a substantially constant or steady speed. In this case, different opening and closing rates may be achieved by the form of the element or other elements which cooperate with the rotating element. Alternatively, or in addition, the element may be rotated at varying speed, for example by incorporating a backlash or lost motion mechanism or arrangement, or by incorporating appropriate gearing or an eccentric mechanism.

The apparatus may include an element configured to respond to changes in fluid flow; such as changes is fluid flow rate, flow speed, or pressure. In one embodiment, the apparatus may include a shock sub which extends is response to elevated internal fluid pressure and is biased to retract in response to lower pressure. The element may be differentially configured or damped, such that the apparatus may respond more quickly to one condition. For example, a shock sub may have little or no damping to prevent the sub extending on experiencing an elevated pressure, but may be damped to slow the retraction response when the pressure falls. Thus, the shock sub may extend quickly in response to a valve opening and then close relatively slowly in response to the valve closing. The difference in the rate of response to the varying pressure experienced by the shock sub tends to urge the apparatus in a downward direction.

According to another aspect of the present invention there is provided a method of translating a member through a bore, the method including:

moving a body of fluid through a tubular member located in a bore;

repeatedly interrupting the passage of the body of fluid at a location in the member to generate pressure surges in the fluid at said location and transfer momentum from the fluid to the member, whereby the member is urged to advance through the bore in the direction of fluid flow.

The fluid may be flowed through the member from surface and the passage of fluid through the member may be interrupted at a distal location in the member. This may be useful for advancing a member into a bore. Alternatively, the fluid may be flowed through the member from a downhole location towards surface. This may be useful in retrieving a member from a bore.

The creation of impulses tending to advance a member in one direction is not reliant on having an axial column of fluid flowing in the desired direction of translation. Thus, the effect is available when the member comprises coil tubing in helical or sinusoidal lockup. Also, the effect may be utilized to assist in retrieving an object from a bore by pumping fluid down through a tubular member but reversing the flow direction in a BHA such that the fluid is flowing upwards before passing the fluid through a valve.

In one embodiment of the invention a downhole tractor-type tool uses the momentum of the fluid flowing in a pipe string to urge the pipe in one direction. When the fluid is flowing through a pipe having a valve and the valve is closed quickly, a very high instantaneous pressure is produced, applying a force or impulse along the axis of the pipe. The magnitude of this pressure pulse (and consequently the magnitude of the force or impulse) is dependent on a number of factors, including the drilling fluid flow rate and on how quickly the valve is opened and/or closed. Relevant factors may include the hydraulic impedance of the tubular member, fluid density, the flow velocity, and the effective modulus of compressibility of the liquid in the pipe. Thus, the excess pressure created on closing the valve may be increased by increasing the rigidity of the entire hydraulic system, including locating the valve downstream of a rigid section of pipe, and increasing the flow velocity above the valve, for example by decreasing the pipe diameter while maintaining mass flow rate, to increase the inertia of the liquid column. One embodiment of the present invention features a rotating valve assembly which repeatedly opens slowly and closes quickly to provide a differential 'hammer' effect to provide a net downward force in the pipe string, allowing the string to advance without the aid of the force of gravity.

According to a still further aspect of the invention there is provided a downhole tractor comprising:

a fluid-transmitting member;

a valve for varying fluid flow in the member;

a fluid-responsive device configured to respond to increases and decreases in fluid flow at rates selected to generate impulses tending to urge the member in a selected direction.

DETAILED DESCRIPTION OF THE INVENTION

Figure 1A:
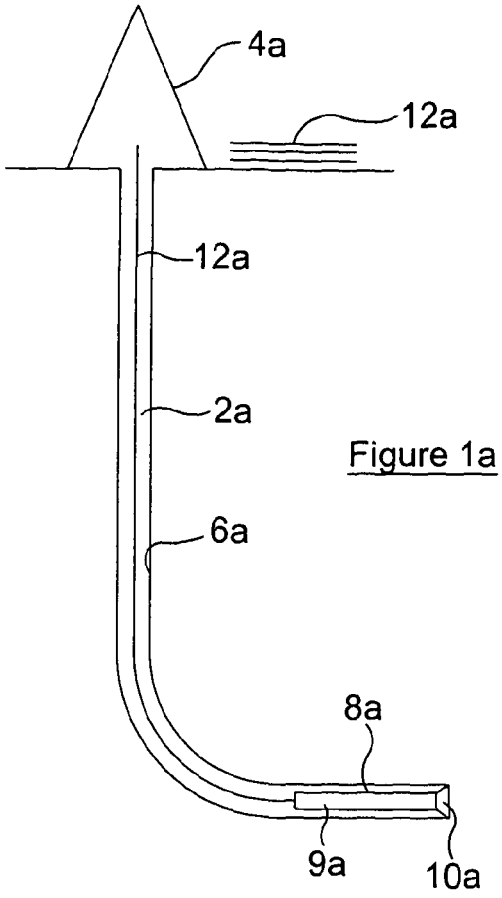
FIG. 1A illustrates a typical well bore drilling operation showing a drill string comprising separate joints of drill pipe and operating with a tractor device of the present invention.
Figure 1B:
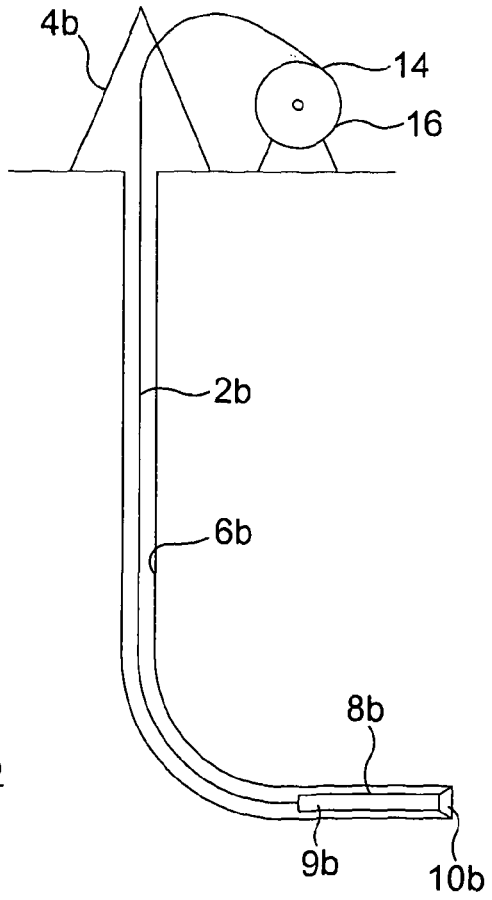
FIG. 1B illustrates a typical coiled tubing-type operation showing a drill string operating with a tractor device of the present invention.

FIG. 1A shows a typical drill string 2A is suspended by a derrick 4A. In this type system, joints of drill pipe 12A are added at the surface as drilling progress to extend the length of the drill string 2A. Alternately, FIG. 1B shows a coiled tubing rig 4B for drilling a borehole 6B into the earth with a continuous length of pipe 2B wherein a large coil of tubing 14 is spooled and unspooled into a reel 16. Both types of systems are used for minerals exploration and recovery, and in particular for recovering hydrocarbons. A bottom-hole assembly (BHA) 8A, 8B is located at the bottom of the borehole 6A, 6B. In directional drilling, the BHA 8A, 8B typically has a downhole steerable drilling system 9A, 9B and comprises a drill bit 10A, 10B for boring into the earth. As the drill bit 10A, 10B rotates downhole it cuts into the earth allowing the drill string 2A, 2B to advance, forming the borehole 6A, 6B.

Drilling fluid is pumped through the drill string from surface during the drilling operation, typically exiting the drill string through nozzles formed in the drill bit. The drilling fluid serves numerous purposes, including cooling the drill bit and carrying drill cuttings away from the drill face, and then transporting the drill cuttings to surface.

In many drilling operations, there is a risk of the pipe 2A, 2B becoming stuck in the borehole 6A, 6B due to curvatures of the boreholes 6A, 6B, friction between the pipe 2A,2B and the borehole wall, differential sticking, and other phenomena familiar to those of skill in the art.

In this embodiment of the invention, drilling boreholes into the earth, the momentum of the drilling fluid flowing in a drill pipe is utilized to urge the drill pipe in one direction preferentially over the other.

This is desirable in those circumstances where the weight of the drill pipe is not enough to overcome the friction experienced by the drill pipe, as happens particularly in drilling deep or tortuous boreholes. When the fluid is flowing through a valve and the valve is closed quickly a very high instantaneous pressure is produced above the valve, and additionally a low instantaneous pressure is produced below the valve. The magnitude of this pressure pulse is dependant on a number of factors, including how quickly the valve is closed, the velocity and mass flow rate of the fluid and the hydraulic impedance of the drill string. Embodiments of the invention relate to a valve which repeatedly opens slowly and relies on the friction between the pipe and the surrounding borehole wall to prevent or reduce movement in one direction, and then closes quickly to preferentially produce movement in the opposite direction by the force exerted by the momentum of the fluid as it decelerates.

In one embodiment, a varying geometry rotating valve is provided, where one valve plate is rotated at a constant speed adjacent to a stationary plate. The shape of apertures in each plate determine the valve opening and closing speeds. A backlash type mechanism may also be utilized.

Therefore the embodiment of the present invention as described below is intended to use the momentum of the fluid being pumped along the string to drive the string forwards. This allows the tool to operate without requiring contact with the wellbore. In effect the tool utilizes the momentum of the fluid and a water hammer effect where a valve is closed rapidly on a flowing column of liquid. The force produced depends on a number of factors, including how rapidly the valve is closed. Therefore if a valve is designed to open slowly and close rapidly it will bias the forces produced and subsequent movement of the string in the direction of fluid flow. This type of asymmetrical valve operation behavior therefore produces a net force in the downhole direction.

A related tool, described in U.S. Pat. No. 6,279,670 incorporated by reference herein for all it discloses, discloses a valve that defines an axial flow passage, the open area of which is varied to produce pressure pulses.

Figure 2:
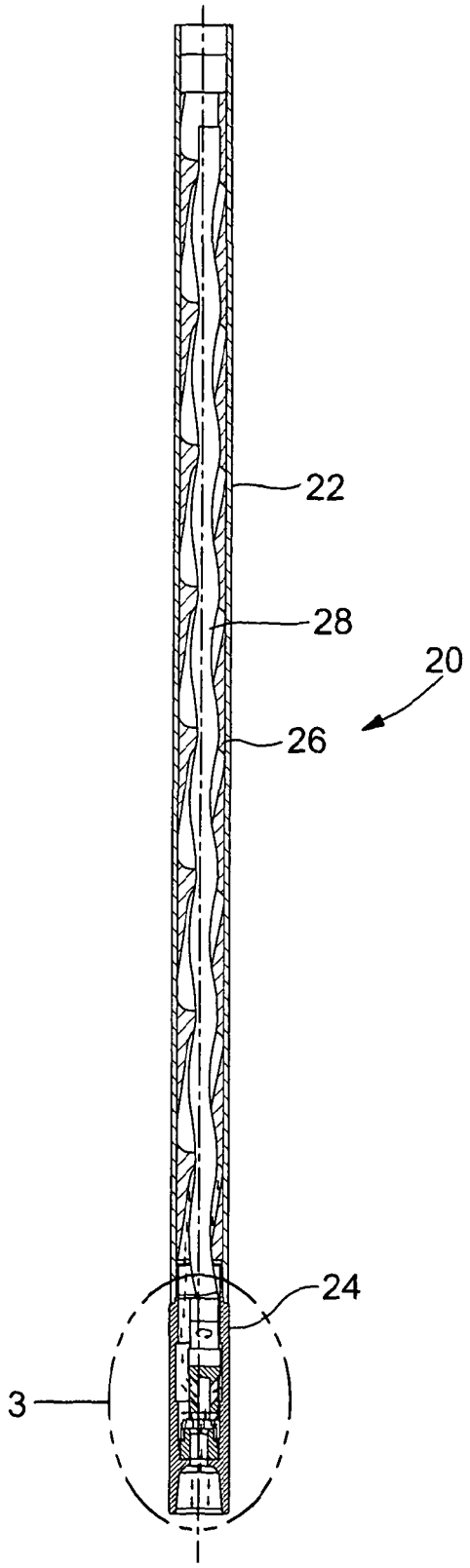
FIG. 2 illustrates a prior art pulsing device useful for drilling operations.
Figure 3:
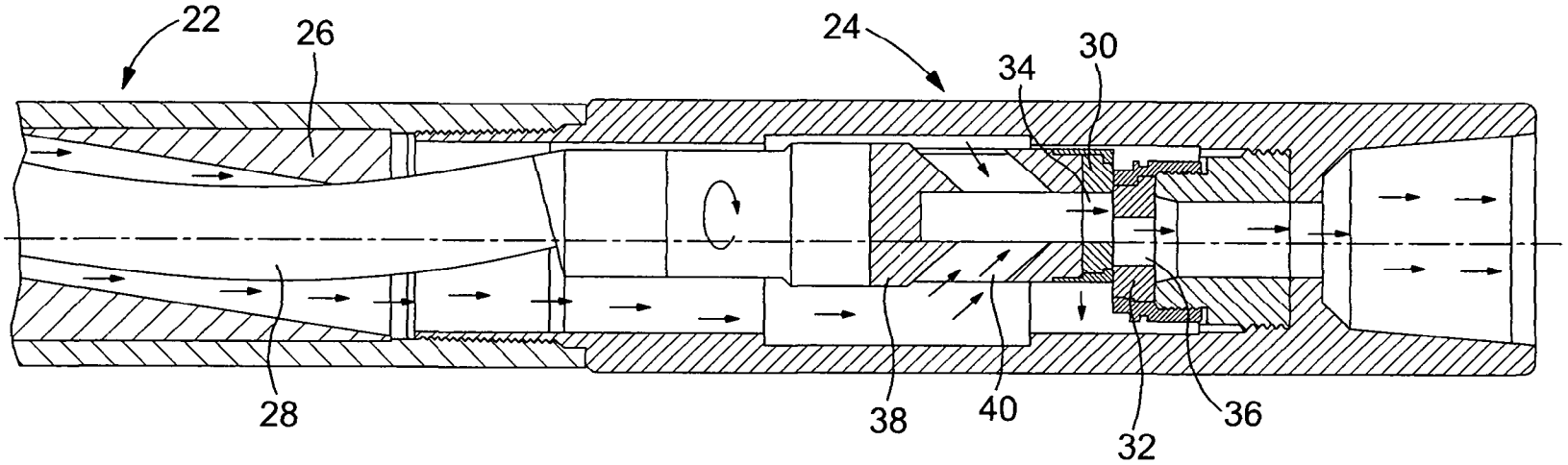
FIG. 3 illustrates a valve arrangement usable for the prior art pulsing device of FIG. 2.

Reference is now made to FIG. 2 of the drawings, which illustrates a prior art pulsing apparatus 20, as described in U.S. Pat. No. 6,279,670, and FIG. 3 which illustrates a valve arrangement of the apparatus 20.

The apparatus 20 includes an elongate tubular body having an upper motor section 22 and a lower valve section 24. The motor section 22 accommodates a Moineau principle motor having a two lobe elastomeric stator 26 and a singe lobe rotor 28. The valve section 24 accommodates first and second valve plates 30, 32, each defining a flow port 34, 36. The first valve plate 30 is directly mounted on the lower end of the rotor 28 via a ported connector 38 defining flow passages 40 which provide fluid communication between the variable geometry annulus defined between the stator 26 and the rotor 28 and the flow port 34. The second valve plate 32 is mounted on the valve section body 24 directly below the first valve plate 30 such that the respective flow ports 34, 36 coincide. As the rotor 28 rotates it oscillates from side-to-side and this movement is transferred directly to the valve plate 30 to provide a cyclic variation in the flow area defined by the flow ports 34, 36.

Figure 4:
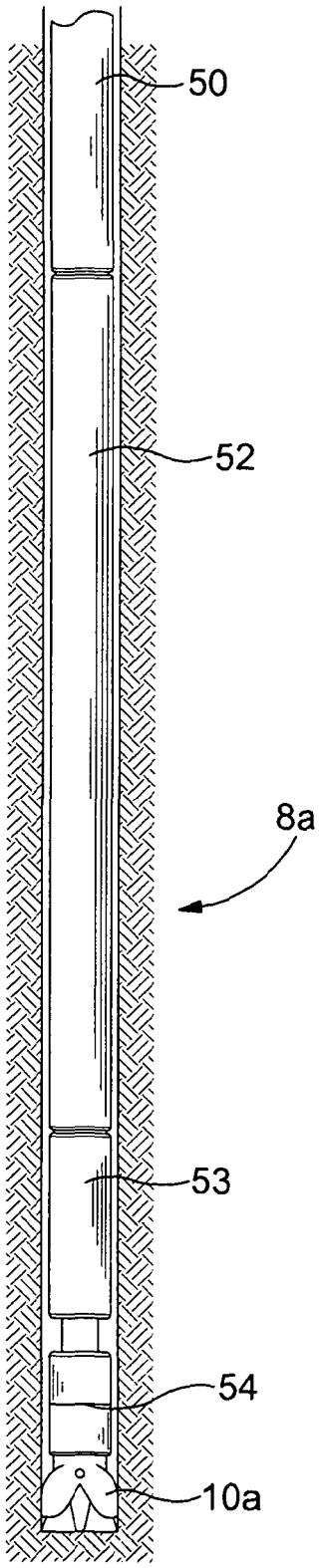
FIG. 4 illustrates the tools forming a bottom hole assembly that may be used with the method of operating a valve of the present invention.
Figure 5:
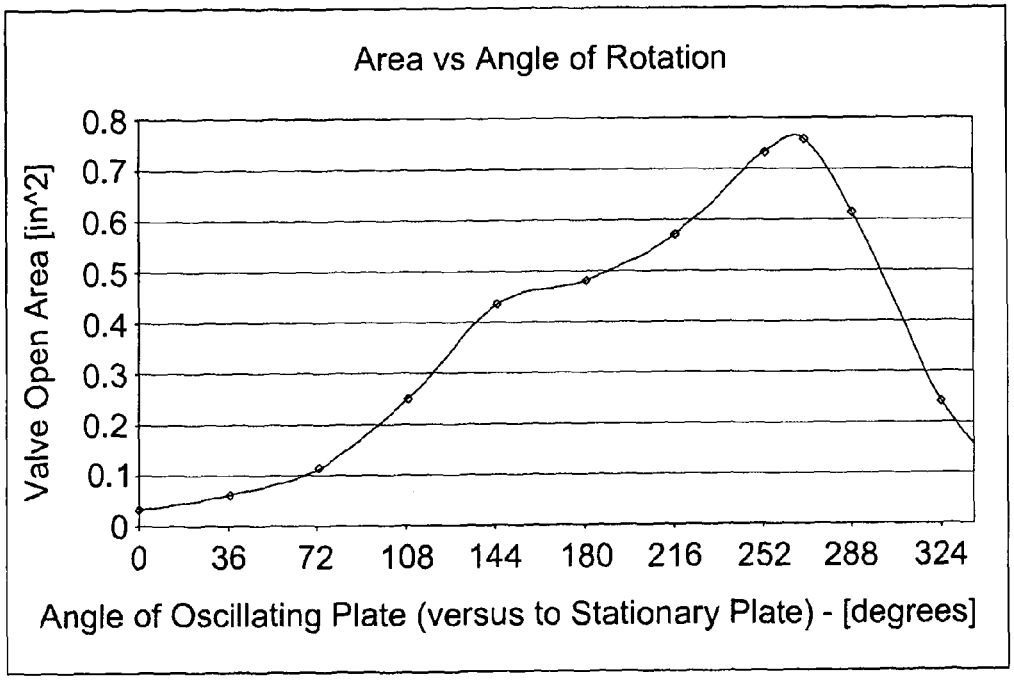
FIG. 5 illustrates the operating characteristics of a valve system made to operate in accordance with one method of operating a valve of the present invention.

Reference is now made to FIG. 4 of the drawings, which illustrates the tools forming the bottom hole assembly 8A that may be used with the method of operating a valve in accordance with an embodiment of the present invention. The BHA 8A comprises a drill collar 50 connected to a tractor 52, the tractor 52 in turn being connected to a shock sub 53 which is attached to a connecting sub 54 which in turn is connected to the drill bit 10A. The tractor 52 incorporates an apparatus 20 comprising an upper motor section and a lower valve section. The upper motor section is similar to the motor section 22 described above. However, the lower valve section is different, as described below. As will be described, with reference to FIG. 5 of the drawings, and also with reference to FIGS. 6 through 15 of the drawings, the valve is configured such that the fluid flow area decreases sharply when the valve is closing, and increases slowly when the valve is opening. This is illustrated in FIG. 5, which illustrates the fluid flow area relative to the valve rotation angle.

FIGS. 6 through 15 of the drawings illustrate elements of the valve system 60 of the tractor 52, viewed from below, looking upstream. The drawings illustrate first and second valve plates 62, 64, each defining a flow port 66, 68. The first valve plate 62 is directly mounted on the lower end of the rotor, in a similar manner to the tool 20 illustrated in FIG. 2. The second valve plate 64 is mounted to the tractor body directly below the first valve plate 62 such that the respective flow ports 66, 68 coincide.

Figure 6:
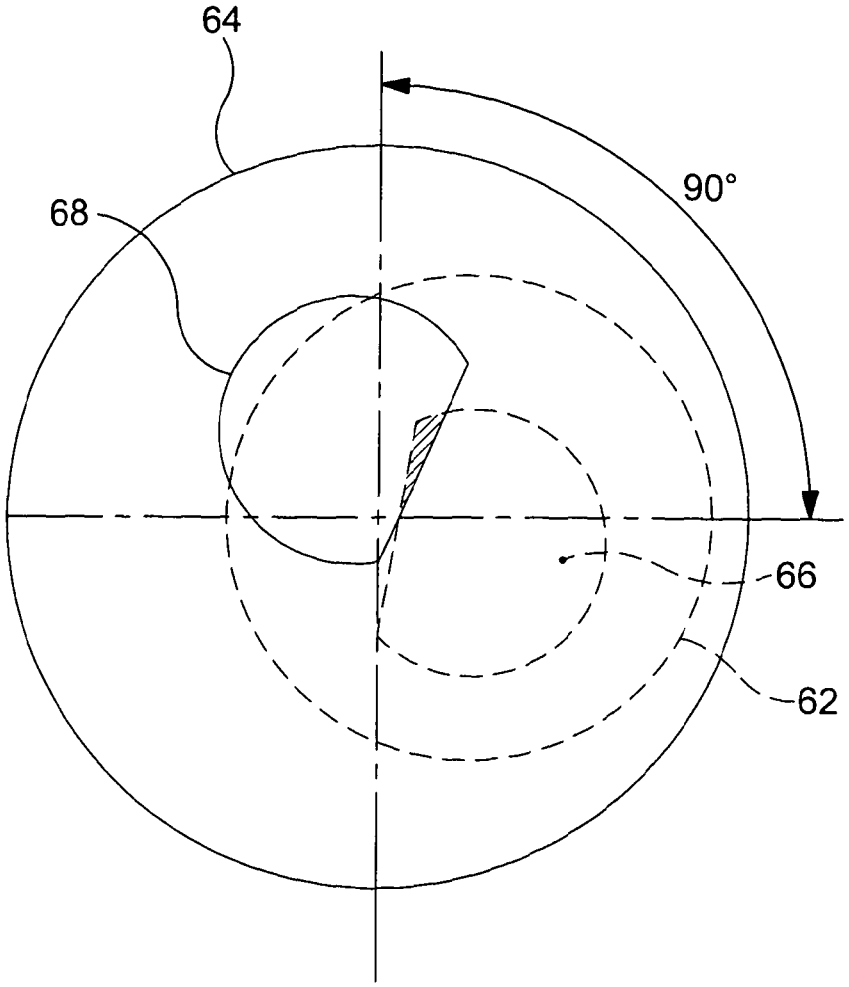
FIG. 6 illustrates a valve system made to operate in accordance with one method of the present invention wherein the orbiting orifice is rotated 90 degrees with respect to the non-rotating orifice.
Figure 7:
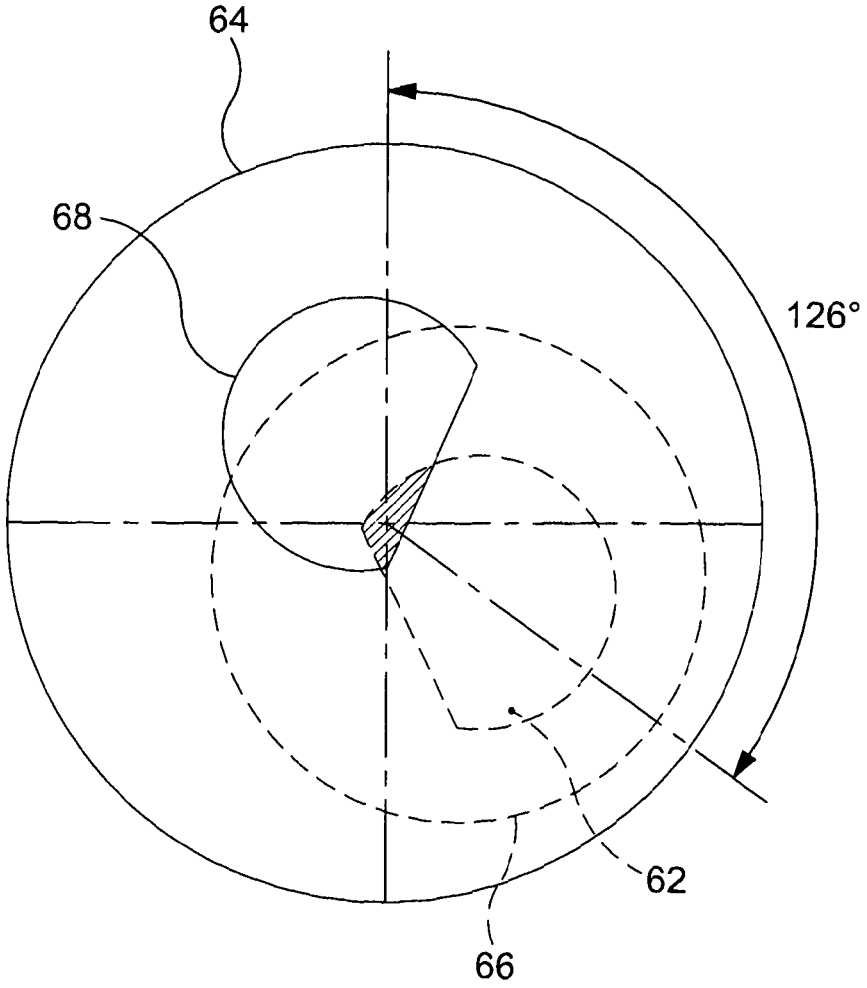
FIG. 7 illustrates a valve system made to operate in accordance with one method of the present invention wherein the orbiting orifice is rotated 126 degrees with respect to the non-rotating orifice.
Figure 8:
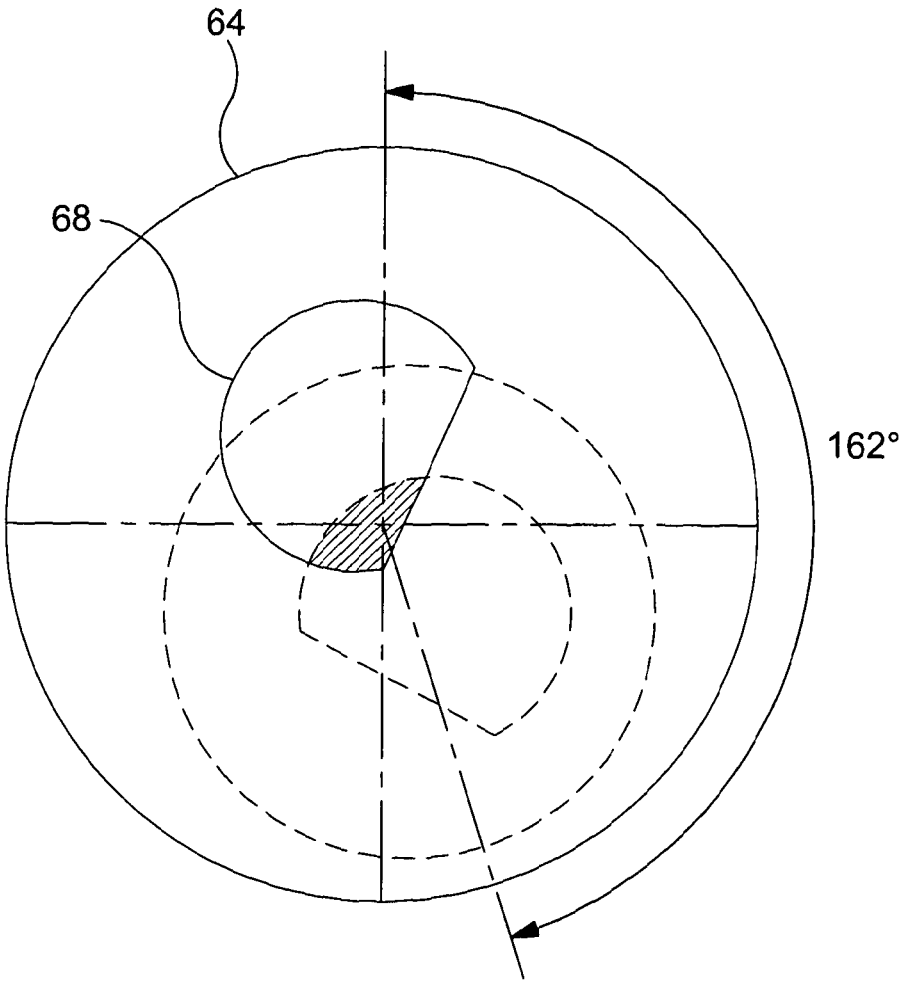
FIG. 8 illustrates a valve system made to operate in accordance with one method of the present invention wherein the orbiting orifice is rotated 162 degrees with respect to the non-rotating orifice.
Figure 9:
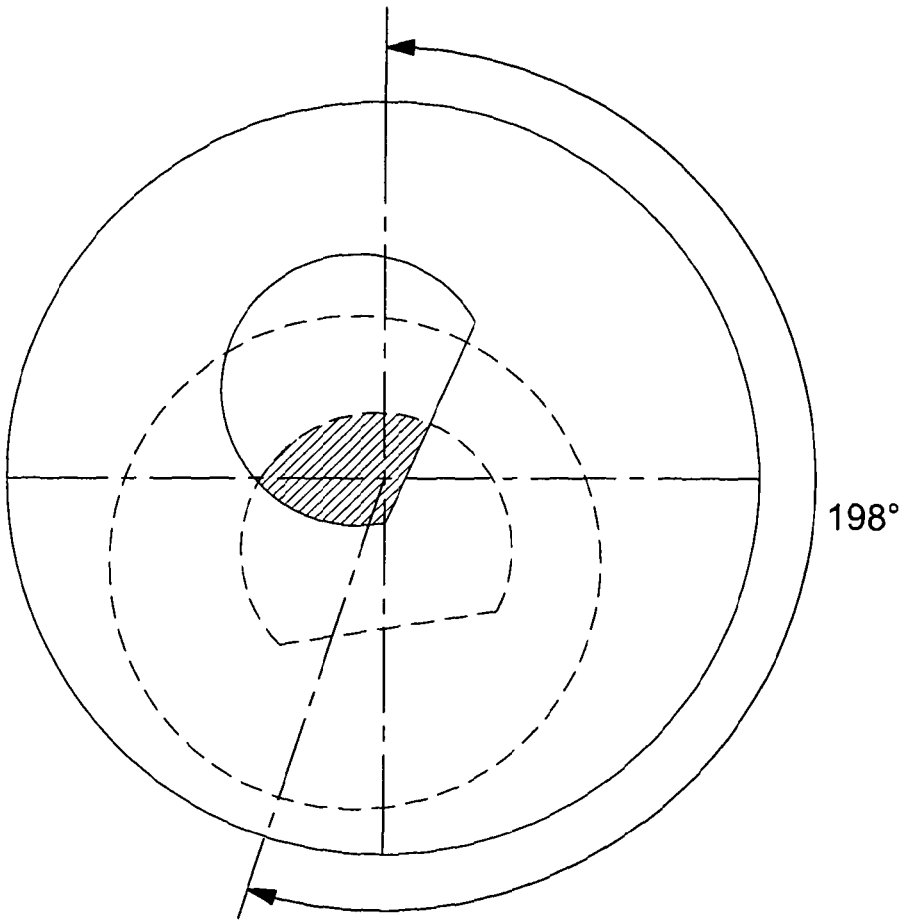
FIG. 9 illustrates a valve system made to operate in accordance with one method of the present invention wherein the orbiting orifice is rotated 198 degrees with respect to the non-rotating orifice.
Figure 10:
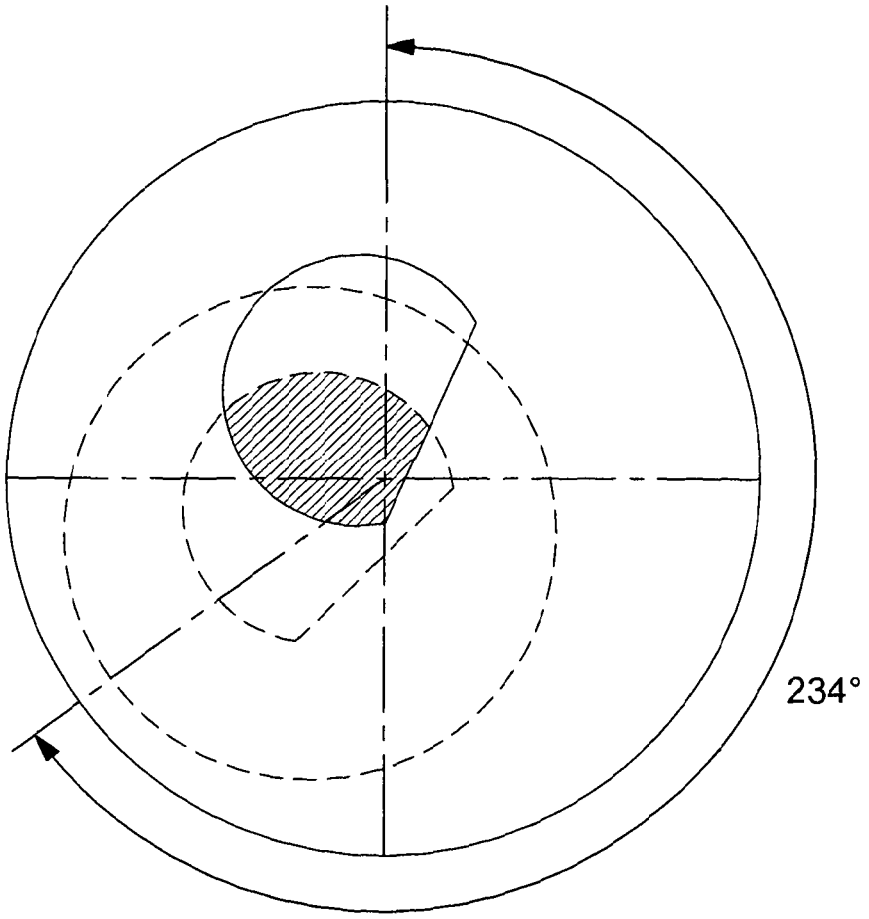
FIG. 10 illustrates a valve system made to operate in accordance with one method of the present invention wherein the orbiting orifice is rotated 234 degrees with respect to the non-rotating orifice.
Figure 11:
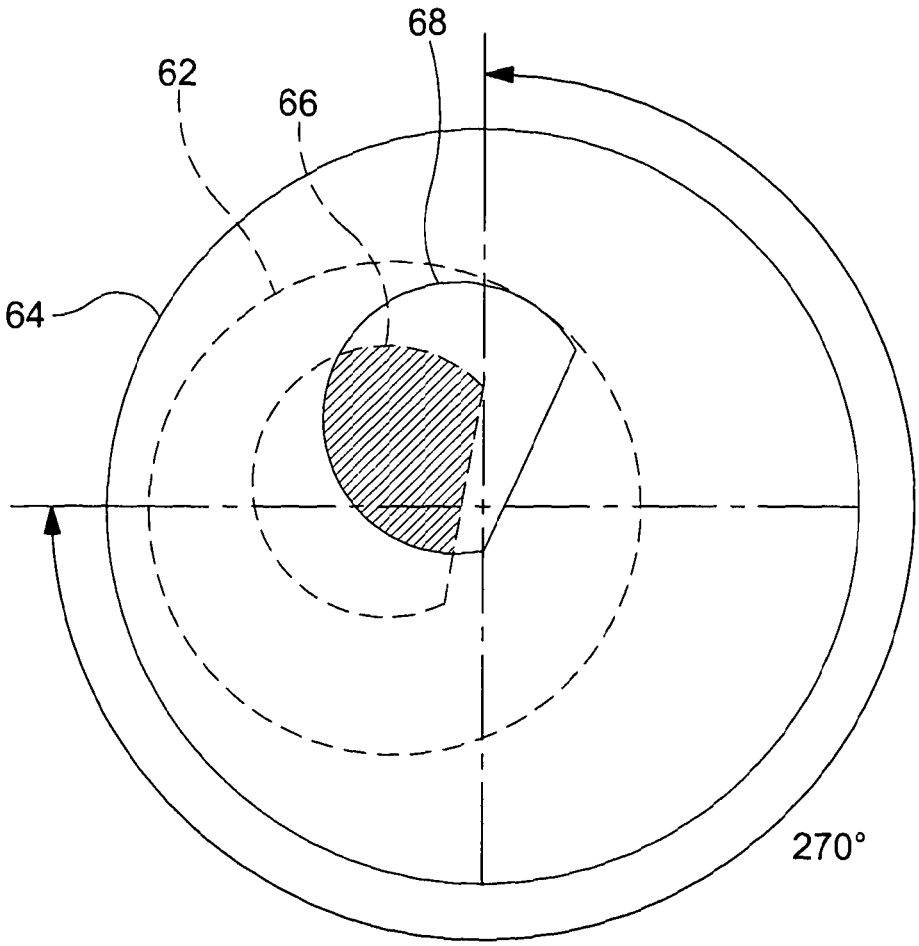
FIG. 11 illustrates a valve system made to operate in accordance with one method of the present invention wherein the orbiting orifice is rotated 270 degrees with respect to the non-rotating orifice.
Figure 12:
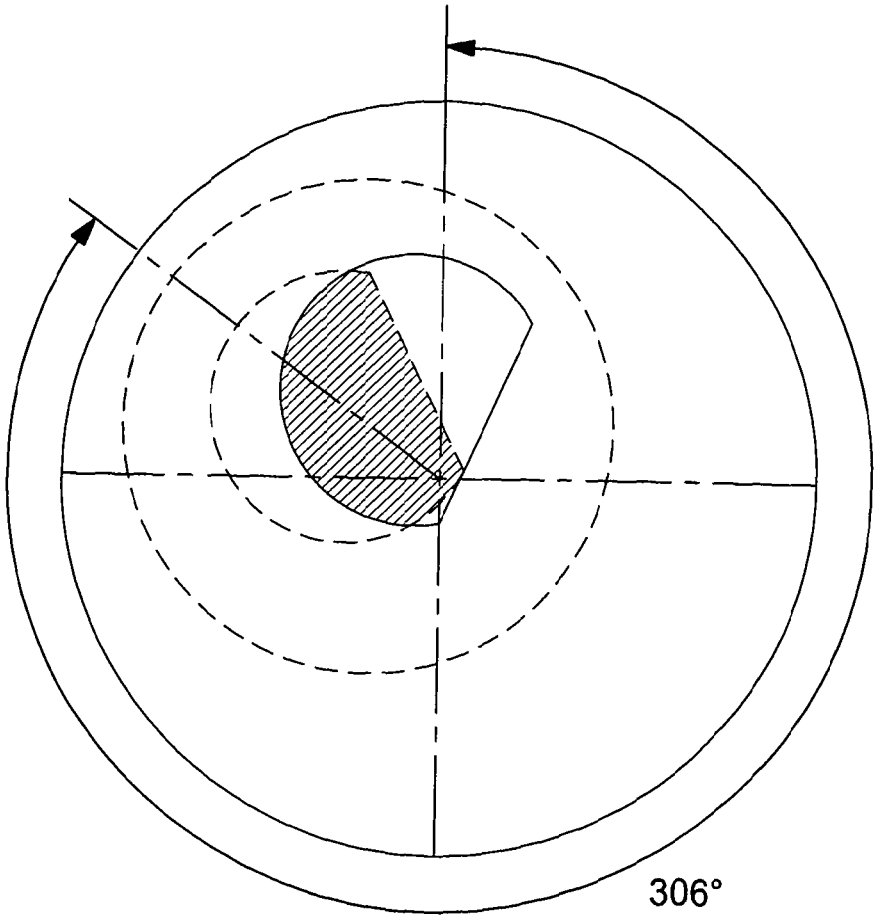
FIG. 12 illustrates a valve system made to operate in accordance with one method of the present invention wherein the orbiting orifice is rotated 306 degrees with respect to the non-rotating orifice.
Figure 13:
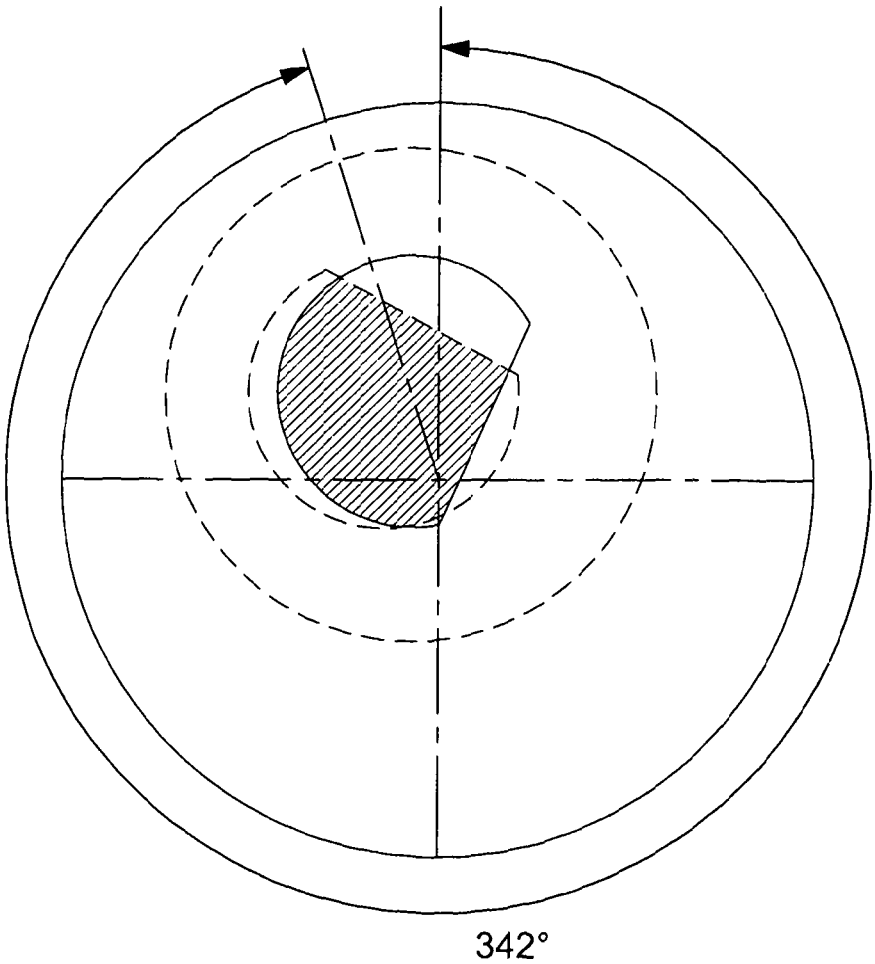
FIG. 13 illustrates a valve system made to operate in accordance with one method of the present invention wherein the orbiting orifice is rotated 342 degrees with respect to the non-rotating orifice.
Figure 14:
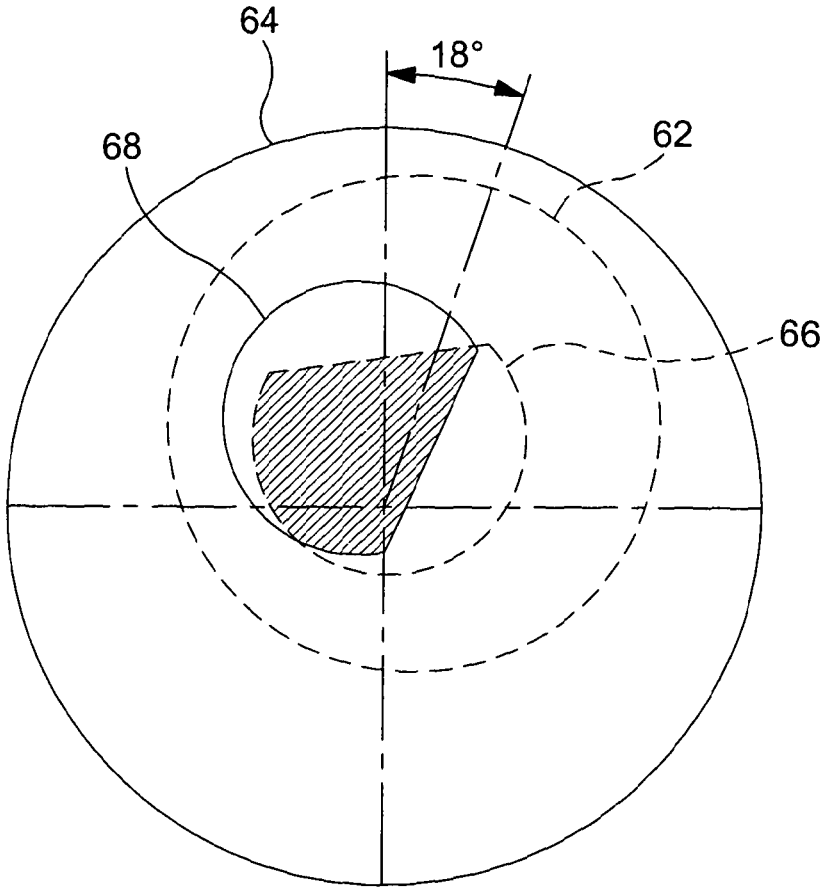
FIG. 14 illustrates a valve system made to operate in accordance with one method of the present invention wherein the orbiting orifice is rotated 18 degrees with respect to the non-rotating orifice.
Figure 15:
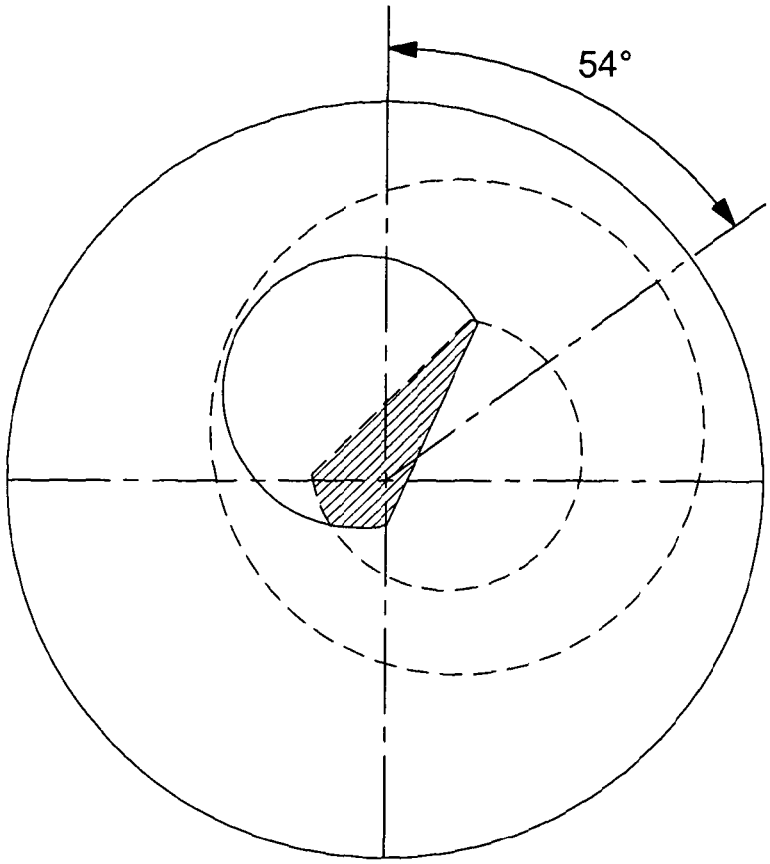
FIG. 15 illustrates a valve system made to operate in accordance with one method of the present invention wherein the orbiting orifice is rotated 54 degrees with respect to the non-rotating orifice.

FIG. 6 illustrates the position of the valve plates 62, 64 just after the valve plates 62, 64 have been completely out of alignment, permitting only minimal flow through the valve system 60 (approximately 4% of the maximum flow area). The rotor and first valve plate 62 rotate counter-clockwise about the rotor axis, while the rotor and valve plate 62 are subject to nutation within the motor stator in a clockwise direction. Each successive figure shows the valve plate 62 having tracked or nutated through a further 36°. It will be noted that the area of overlap between the flow ports 66, 68, and thus the flow area, initially increases only very slowly, and then increases more quickly until a maximum flow area is defined, around the configuration as illustrated in FIG. 13. From this relative position, the flow area decreases relatively quickly, over approximately 75 degrees of rotation, thus providing the desired water-hammer effect, as described above. In testing with such a valve and utilizing water at mains pressure as the working fluid, pressure peaks or surges in the region of 1000 psi were achieved.

The motor and valve may be run at an appropriate speed with reference to the tractor configuration and other circumstances. However, a motor running at 5 to 20 Hz, and in particular around 12 to 30 Hz, provides a useful tractor-like effect.

Figure 16:
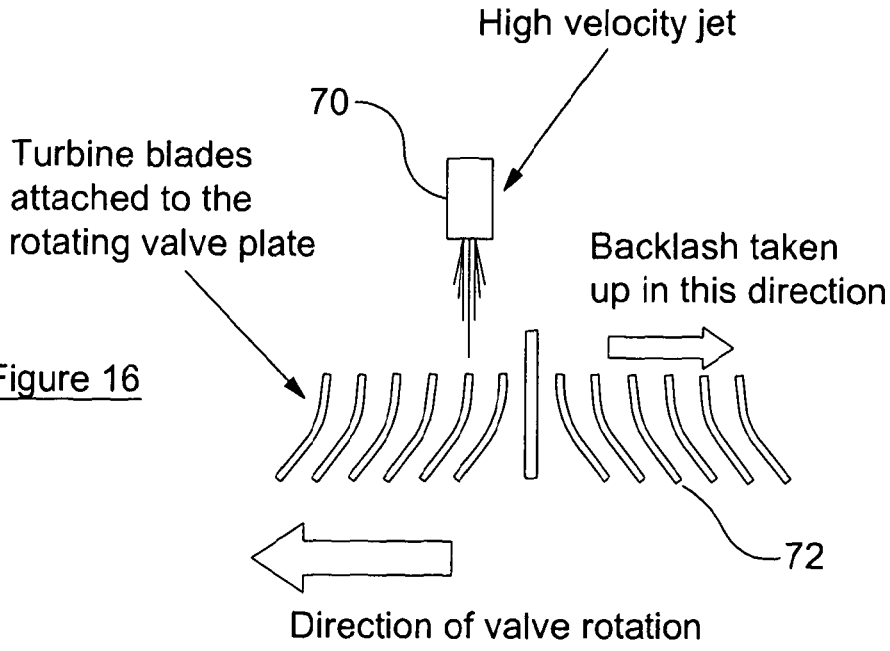
FIGS. 16 and 17 illustrate a valve system made to operate in accordance with one method of the present invention wherein a backlash mechanism induces a transient reverse motion to the rotating valve to cause an effective area change in the valve.
Figure 17:
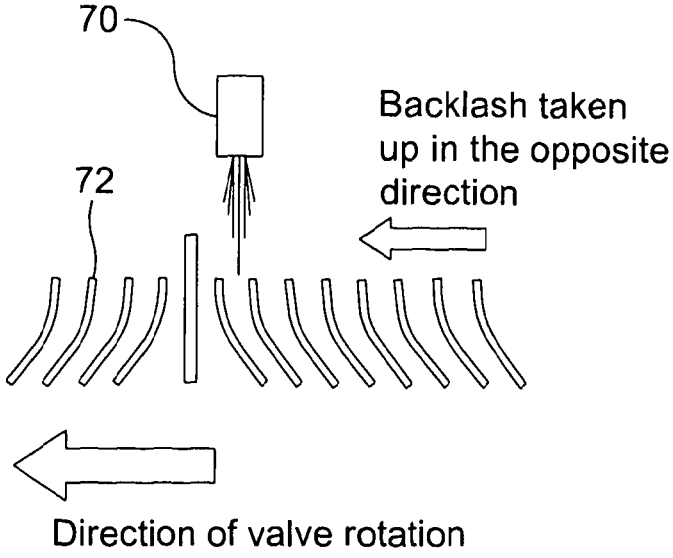

In an alternative embodiment, the drive system between the positive displacement motor and the first valve plate is modified to provide significant backlash, and such a system is shown schematically in FIGS. 16 and 17 of the drawings. This arrangement provides for slow, regular motion until a stage where the valve plate takes up the backlash and closes the valve quickly. This backlash reversal is powered by turbine blades that only come into action for part of a rotation and cause the rotating valve plate to run ahead of the mechanical drive until the valve closes. Then the rotational drive opens the valve slowly. As illustrated in FIGS. 16 and 17, a jet 70 impinges on turbine blades 72 attached to the rotating valve plate. The valve plate is rotated by the positive displacement motor and at a critical point the turbine blades change direction. This results in the backlash suddenly being taken up in the opposite direction, allowing the valve plate to run slightly ahead of the drive system and closing the valve rapidly. The drive motor then opens the valve slowly and at a non-critical point during the valve rotation and the turbine blades are reversed again to reset the mechanism ready for the next cycle.

In other embodiments, a valve having a more regular opening and closing cycle may be utilized, and combined with a shock sub that is damped against movement in one direction but substantially undamped against movement in the opposite direction. A shock sub may include two telescoping parts, one part defining a differential piston tending to extend the sub on exposure to an elevated internal pressure. A compression spring between the parts biases the parts to assume a shorter retracted configuration. Thus, for example, as the valve opens the substantially undamped shock sub is able to extend relatively quickly, following the initial opening of the valve. However, the retraction of the shock sub is damped, such that the retraction of the shock sub on closing of the valve is relatively slow, and continues steadily as the valve closes. The alternating action of the shock sub provides a net downward force on the string, and facilitates downward movement of the string.

In an alternative arrangement, the damping on the shock sub may be reversed, with a view to providing a net upward force on the string, which may be useful in retrieving stuck objects or pipes.

In still further embodiments, a valve that opens and closes at different rates may be combined with a shock sub with variable damping.

Whereas the present invention has been described in particular relation to the drawings attached hereto, it should be understood that other and further modifications apart from those shown or suggested herein, may be made within the scope and spirit of the present invention.

What is claimed is:

1. A method of translating a member through a bore, the method comprising:

moving fluid through a tubular member located in the bore;

generating impulses on the member by varying passage of fluid through the member by opening a flow passage at a first rate and closing the flow passage at a different second rate to urge the member to advance in a selected direction; and operating a valve to interrupt flow of the fluid.

2. The method of claim 1, comprising opening the flow passage at the first rate and closing the flow passage at a slower second rate.

3. The method of claim 1, comprising opening the flow passage at the first rate and closing the flow passage at a faster second rate.

4. The method of claim 1, comprising moving a flow barrier mounted in the member.

5. The method of claim 4, comprising operating a valve to interrupt flow of the fluid.

6. A downhole tractor, comprising:

a fluid-transmitting member; and a valve comprising a rotating element to vary fluid flow in the member, the valve movable at a first rate to an open position and at a different second rate to a closed position to generate impulses from fluid flowing through the member and tending to urge the member in a selected direction.

7. The tractor of claim 6, wherein the first rate is faster than the different second rate.

8. The tractor of claim 6, wherein the first rate is slower than the different second rate.

9. The tractor of claim 6, wherein the valve comprises relatively movable elements which cooperate to define a varying flow area and at least one of a form of the elements and a relative movement of the elements provides different first and second rates.

10. The tractor of claim 6, wherein the element is rotatable at a steady speed.

11. The tractor of claim 6, wherein the element is rotatable at a varying speed.

12. The tractor of claim 11, wherein the valve includes a backlash mechanism.

13. The tractor of claim 6, further comprising an element responsive to changes in fluid flow.

14. The tractor of claim 13, wherein the element responsive to changes in fluid flow comprises a shock sub which tends to extend or retract in response to elevated internal fluid pressure and tends to retract or extend in response to lower internal fluid pressure.

15. The tractor of claim 14, wherein the element dampable such that the tractor responds more quickly to one fluid flow condition and more slowly to another fluid flow condition.

16. The tractor of claim 15, wherein the element comprises a shock sub having little or no damping to prevent the shock sub from extending on experiencing an elevated pressure, and being damped to slow the retraction response when the pressure falls.

17. The tractor of claim 6, wherein the fluid transmitting member includes at least a section of one of: coil tubing; drill string; a work string; completion or production tubing; casing and liner.

18. The tractor of claim 6, wherein the fluid-transmitting member includes, is coupled with, or otherwise associated with a bottom hole assembly (BHA), a tool or a device mounted on a support member.

19. The tractor of claim 6, wherein the valve is integrated with the member and run-in and retrievable together with the member.

20. The tractor of claim 6, wherein the valve is mounted in a substantially rigid section of the member.

21. The tractor of claim 6, wherein the valve is driven by a motor.

22. The tractor of claim 21, wherein the motor is fluid actuated.

23. The tractor of claim 22, wherein the motor comprises a positive displacement motor.

24. The tractor of claim 22, wherein the motor comprises a turbine.

25. A method of translating a member through a bore, the method comprising:

flowing fluid through the member located in the bore; and repeatedly interrupting flow of the fluid at a location in the member to generate pressure variations in the fluid at said location, a variable length element of the member responding more quickly to one fluid flow condition and more slowly to another fluid flow condition to generate impulses whereby the member is urged to advance through the bore in the direction of fluid flow;

wherein the element comprises a shock sub and is subject to a first level of damping on the shock sub from extending on experiencing an elevated pressure, and is subject to a higher second level of damping on experiencing the lower internal fluid pressure, whereby the element responds more quickly to the elevated pressure.

26. The method of claim 25, wherein the element extends or retracts in response to elevated internal fluid pressure and retracts or extends in response to lower internal fluid pressure.

27. The method of claim 25, wherein fluid is flowed through the member from surface and passage of fluid through the member is interrupted at a distal location in the member.

28. The method of claim 25, wherein fluid is flowed through the member from a downhole location and towards surface.

29. A downhole tractor, comprising:

a fluid-transmitting member;

a valve for varying a fluid flow condition in the member; and a fluid-responsive device responsive to changes in the fluid flow condition and such that the device responds more quickly to one fluid flow condition and more slowly to another fluid flow condition to generate impulses tending to urge the member in a selected direction.

30. The tractor of claim 29, wherein the device comprises a shock sub extendable or retractable in response to elevated internal fluid pressure and to retract or extend in response to lower internal fluid pressure.

31. The tractor of claim 30, wherein the device responds more quickly to one pressure condition and more slowly to another pressure condition.

32. The tractor of claim 31, wherein the device comprises a shock sub having little or no damping to prevent the shock sub from extending on experiencing an elevated pressure, and being damped to slow the retraction response when the pressure falls.

33. A method of translating a member through a bore, the method comprising:

moving fluid through a tubular member located in the bore; and generating impulses on the member by varying passage of fluid through the member by opening a flow passage at a first rate and closing the flow passage at a different second rate to urge the member to advance in a selected direction.

* * * * *